US010773403B2

(12) United States Patent
Washington et al.

(10) Patent No.: US 10,773,403 B2
(45) Date of Patent: Sep. 15, 2020

(54) SHAVING RAZOR HANDLE

(71) Applicant: The Gillette Company LLC, Boston, MA (US)

(72) Inventors: Jack Anthony Washington, Mendon, MA (US); Matthew Michael Long, Methuen, MA (US); Robert Harold Johnson, Hingham, MA (US); Steven Michael Bourque, Billerica, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/367,353

(22) Filed: Mar. 28, 2019

(65) Prior Publication Data

US 2019/0299446 A1 Oct. 3, 2019

Related U.S. Application Data

(60) Provisional application No. 62/650,397, filed on Mar. 30, 2018.

(51) Int. Cl.
*B26B 21/22* (2006.01)
*B26B 21/52* (2006.01)

(52) U.S. Cl.
CPC ..... *B26B 21/225* (2013.01); *B26B 21/222* (2013.01); *B26B 21/521* (2013.01)

(58) Field of Classification Search
CPC ..... B26B 21/00; B26B 21/22; B26B 21/222; B26B 21/225; B26B 21/227; B26B 21/52; B26B 21/521; B26B 21/522; B26B 21/523; B26B 21/525
USPC ..... 30/47–51, 526–527
See application file for complete search history.

(56) References Cited

U.S. PATENT DOCUMENTS 3,786,563 A * 1/1974 Dorion, Jr. ..... B26B 21/24 30/50
4,562,644 A * 1/1986 Hitchens ..... B26B 21/44 30/41
4,888,868 A * 12/1989 Pritchard ..... B26B 21/446 30/41
5,307,564 A * 5/1994 Schoenberg ..... B26B 21/00 30/47
5,533,263 A * 7/1996 Gilder ..... B26B 21/225 30/530
5,560,106 A * 10/1996 Armbruster ..... B26B 21/225 30/526
5,575,068 A * 11/1996 Pedersen ..... B26B 21/222 30/47
5,673,485 A * 10/1997 Hill ..... B26B 21/446 30/41.5
5,687,485 A * 11/1997 Shurtleff ..... B26B 21/522 30/526

(Continued)

*Primary Examiner* — Andrea L Wellington
*Assistant Examiner* — Richard D Crosby, Jr.
(74) *Attorney, Agent, or Firm* — John M. Lipchitz

(57) ABSTRACT

A shaving razor handle with an elongated gripping portion at a first end. A cartridge interconnector at a second end of the elongated gripping portion has a platform with an upper surface and an opposing lower surface that defines an included angle of about 35 degrees to about 60 degrees. A distal end of the cartridge interconnector extends from the platform. The distal end has a skin facing surface with a pair of side walls connected by a pair of curved lateral end walls.

20 Claims, 7 Drawing Sheets

(56) References Cited

U.S. PATENT DOCUMENTS 6,026,577 A * 2/2000 Ferraro ..... B26B 21/22 30/50
6,052,903 A * 4/2000 Metcalf ..... A45D 27/225 30/40.2
6,138,361 A * 10/2000 Richard ..... B26B 21/225 30/50
6,141,875 A * 11/2000 Andrews ..... B26B 21/00 30/50
6,161,287 A * 12/2000 Swanson ..... B26B 21/225 30/50
D446,884 S * 8/2001 Kohring ..... D28/48
6,276,061 B1 * 8/2001 Rozenkranc ..... B26B 21/22 30/34.1
6,276,062 B1 * 8/2001 Prochaska ..... B26B 21/222 30/48
6,526,660 B1 * 3/2003 MacNeil ..... B26B 21/222 30/50
6,598,303 B2 * 7/2003 Bosy ..... B26B 21/225 30/50
6,655,028 B2 * 12/2003 Coffin ..... B26B 21/44 30/41
6,754,958 B2 * 6/2004 Haws ..... B26B 21/446 222/399
6,789,321 B2 * 9/2004 Simms ..... B26B 21/446 30/41
6,807,739 B2 10/2004 Follo
6,973,730 B2 * 12/2005 Tomassetti ..... B26B 21/225 30/527
8,104,184 B2 * 1/2012 Walker ..... B26B 21/4012 30/527
8,191,263 B2 * 6/2012 Follo ..... B26B 21/44 30/41
8,650,763 B2 * 2/2014 Howell ..... B26B 21/225 30/50
8,769,825 B2 * 7/2014 Howell ..... B26B 21/225 30/50
8,793,879 B2 * 8/2014 Jessemey ..... B26B 21/446 30/41
8,826,543 B2 9/2014 Szczepanowski
9,193,077 B2 11/2015 Worrick
9,283,685 B2 * 3/2016 Griffin ..... B26B 21/521
9,381,657 B2 * 7/2016 Xu ..... B26B 21/4012
9,469,038 B2 * 10/2016 Iaccarino ..... B26B 21/521
9,475,202 B2 * 10/2016 Griffin ..... B26B 21/225
2016/0250764 A1 * 9/2016 Hashimoto ..... B26B 21/225 30/47

* cited by examiner

SHAVING RAZOR HANDLE

FIELD OF THE INVENTION

The present invention relates to wet shaving safety razors and more particularly to shaving systems having handles and replaceable cartridges.

BACKGROUND OF THE INVENTION

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

Shaving systems often consist of a handle and a replaceable cartridge in which one or more blades are mounted in a plastic housing. After the blades in a cartridge have become dull from use, the cartridge is discarded, and replaced on the handle with a new cartridge. These types of shaving systems that utilize a variety of connection schemes to affix the cartridge to the handle have become popular. The connection scheme allows the consumer to easily, repeatedly, efficiently and intuitively load and remove the new and used cartridges from the handle and provides the necessary retention forces to maintain the integrity of the handle-to-cartridge attachment during shaving.

The connection scheme must be robust enough to provide the necessary retention forces to maintain the integrity of the handle-to-cartridge attachment during shaving. The attachment of a razor cartridge to razor handle can provide sufficient retaining force to secure the razor cartridge to the razor handle over a wide variety of shaving conditions. Some shavers use very high forces when shaving and some razors may have a hair trimming system mounted on the side or back of the razor cartridge. In contrast, razors that use razor cartridges that are releasably connected, can provide low attachment and release forces to facilitate easy changing of cartridges by a shaver.

The razor cartridge of many razors can also be in pivotal relationship with the razor handle. Most existing razors typically provide the mechanism that enables this pivot relationship on the razor cartridge or at the interface of the razor cartridge and razor handle. These pivot mechanisms can be expensive to manufacture and can represent a significant fraction of the total manufactured cost of a razor cartridge. Accordinlgy, there is a need for a simpler, less expensive, more intuitive and reliable shaving handle-to-cartridge connection.

SUMMARY OF THE INVENTION

In one aspect, the invention features, in general a shaving razor handle with an elongated gripping portion at a first end. A cartridge interconnector at a second end of the elongated gripping portion has a platform with an upper surface and an opposing lower surface that defines an included angle of about 35 degrees to about 60 degrees. A distal end of the cartridge interconnector extends from the platform. The distal end has a skin facing surface with a pair of side walls connected by a pair of curved lateral end walls.

In another aspect, the invention features, in general a shaving razor handle with an elongated gripping portion having a first end. A cartridge interconnector at a second end of the elongated gripping portion has a platform with a shoulder and a distal end extending from the platform that has a skin contacting surface. A height of the distal end from the shoulder of the platform to the skin facing surface is about 0.5 mm to about 3 mm and a distance from the shoulder of the platform to a ledge on an upper surface of the platform is about 3 mm to about 6 mm.

In another aspect, the invention features, in general a shaving razor handle with an elongated gripping portion having a first end. A cartridge interconnector at a second end of the elongated gripping portion has a platform with an upper surface and an opposing lower surface that defines an included angle of about 35 degrees to about 60 degrees. A distal end having a skin facing surface extends from the platform. The lower surface of the platform and a side wall of the distal end define an included angle of about 125 degrees to about 150 degrees.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
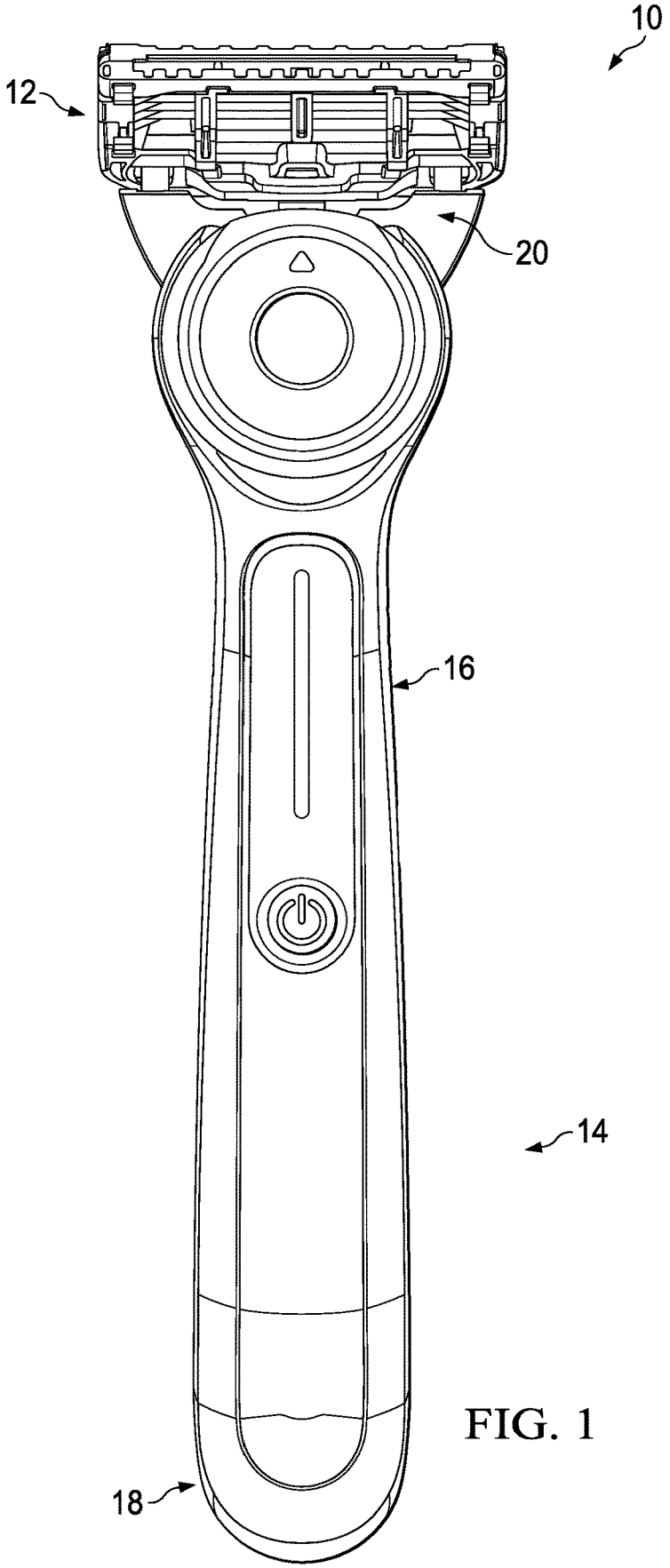
FIG. 1 is a perspective view of a shaving razor system according to one possible embodiment of the present invention.

Referring to FIG. 1, a perspective view of a shaving razor system 10 is shown. The shaving razor system 10 may include a shaving razor cartridge 12 mounted to handle 14. The shaving razor cartridge 10 may be removable or permanently mounted to the handle. For example, the shaving razor cartridge 12 may be mounted detachably on the handle 14 to enable the shaving razor cartridge 12 to be replaced by a fresh shaving razor cartridge 12 when the blade sharpness has diminished to an unsatisfactory level, or it may be attached permanently to the handle with the intention that the entire razor be discarded when the blade or blades have become dulled. The shaving razor handle 14 may have an elongated gripping portion 16 with a first end 18 (e.g., distal end) and a second end 20 (e.g., proximal end).

Figure 2:
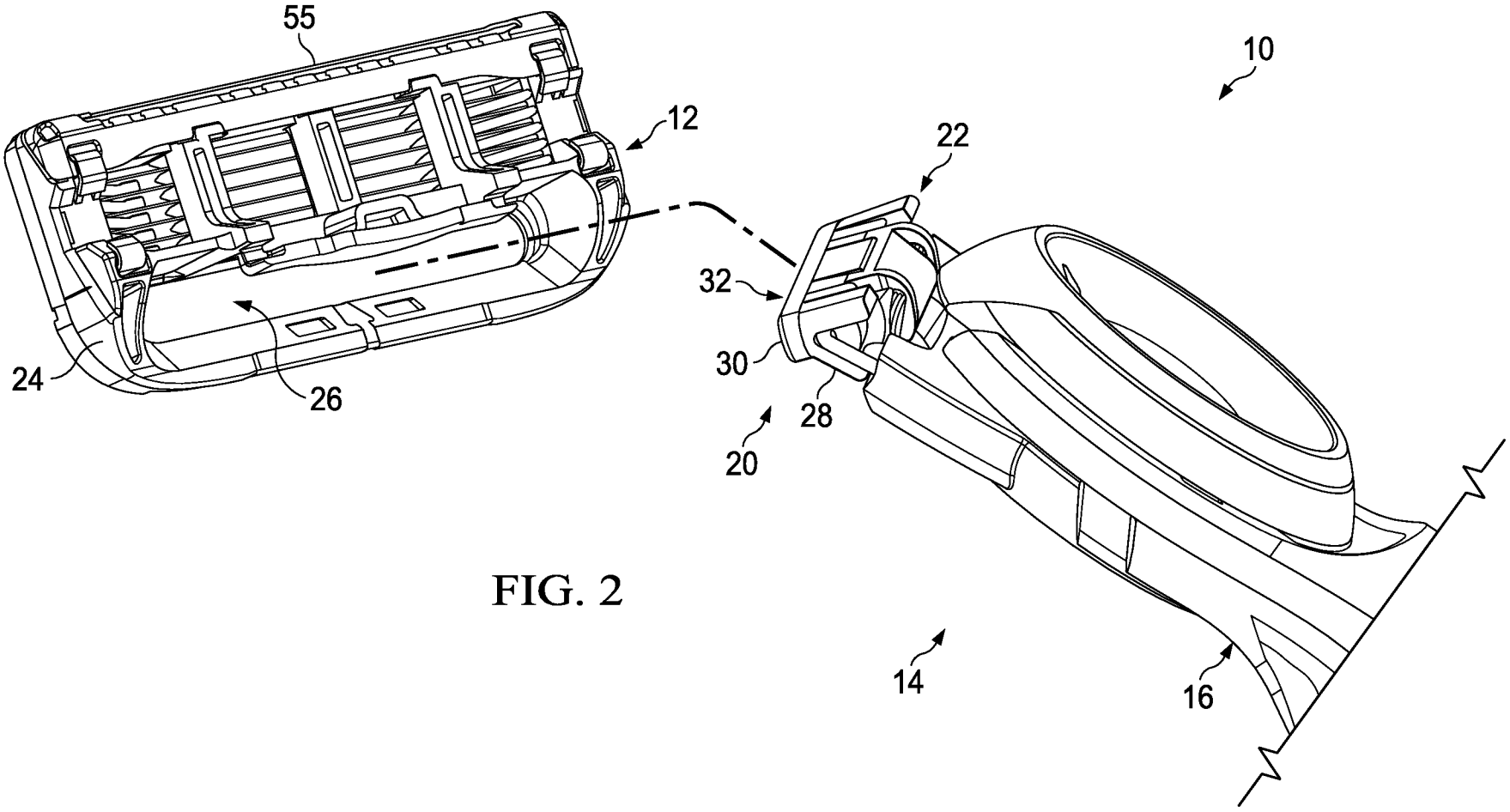
FIG. 2 is a partial assembly view of the shaving razor system of FIG. 1.

Referring to FIG. 2, a partial assembly view of the shaving razor system 10 of FIG. 1 is shown with the cartridge 12 detached from the shaving razor handle 14. The shaving razor handle 14 may have a cartridge interconnector 22 at the second end 20. The cartridge interconnector 22 may pivot relative to the elongated gripping portion 16 of the shaving razor handle 14. Accordingly, it is not necessary for the cartridge interconnector 22 to be attached to the shaving razor cartridge 12 in order to pivot relative to the elongated gripping portion 16 of the handle 14. The shaving razor cartridge 12 may have a housing 24 that defines an opening 26 configured to receive the cartridge interconnector 22. The cartridge interconnector 22 may include a platform 28 that is positioned within the opening 26 of the housing 24. A distal end 30 may extend from cartridge interconnector 22 to a skin facing surface 32. It is understood that the skin facing surface 32 (e.g., skin contacting surface) may extend through the opening 26 of the shaving razor cartridge 12 to contact the surface of the skin to provide a benefit. Examples of benefits may include delivery of heat and/or a moisturizer to the surface of the skin of a user. In certain embodiments, the skin facing surface 32 may extend completely through the housing 24. However, the skin facing surface 32 may or may not directly contact the skin.

Figure 3A:
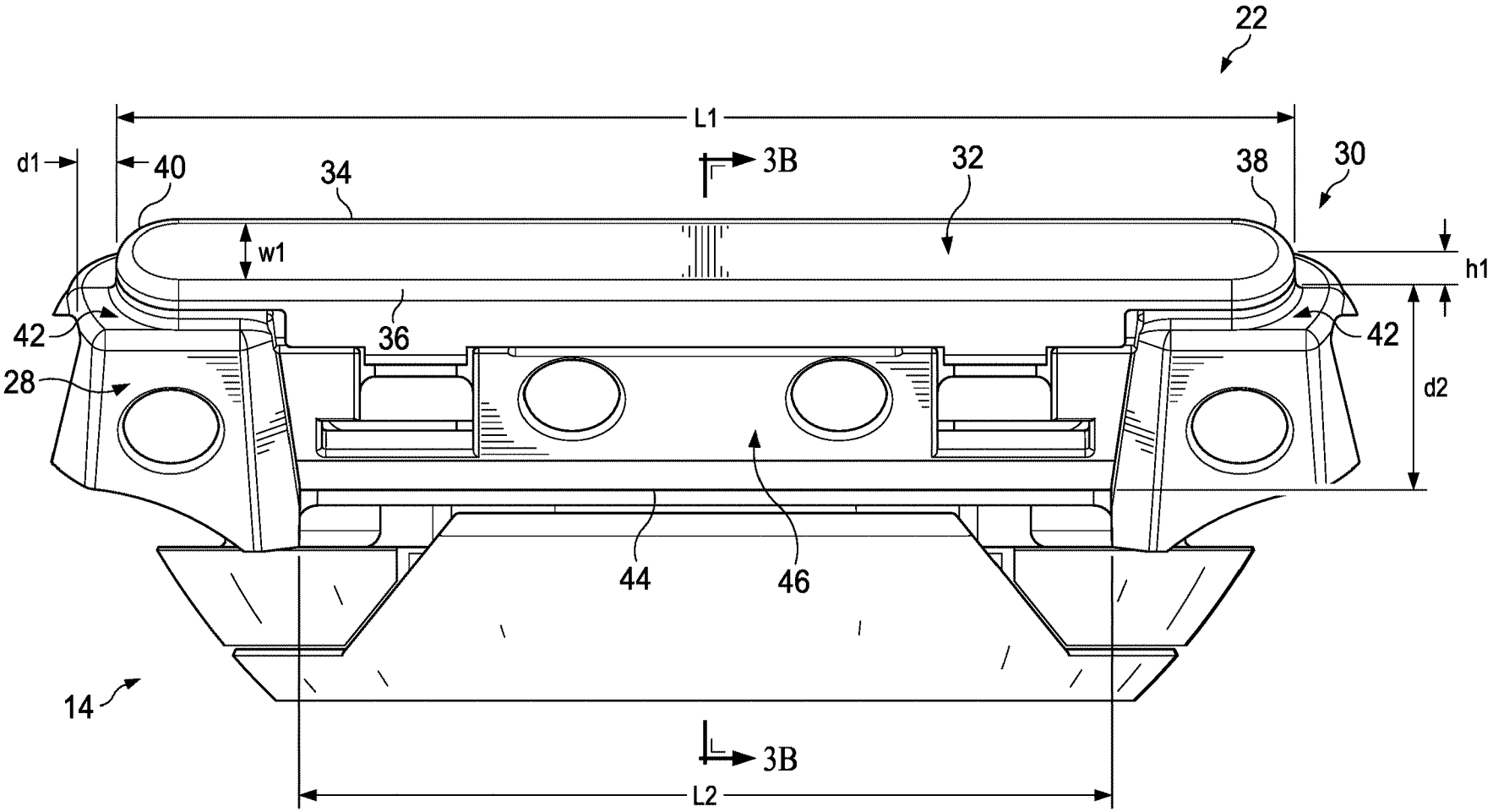
FIG. 3A is a front partial view of the shaving razor handle of FIG. 2

Referring to FIG. 3A, an enlarged front view of the catridge interconnector 22 on the handle 14 is illustrated. The skin facing surface 32 may have a pair of side walls 34 and 36. The side walls 34 and 36 may be parallel to each other. The side walls 34 and 36 may be interconntected by a pair of curved lateral end walls 38 and 40. For example, the pair of curved end walls 38 and 40 may have a radius of about 1.25 mm to about 2 mm. The curved lateral end walls 38 and 40 may provide a more precise fit with the shaving razor cartridge 12 (FIG. 2) by minimizing gaps between the razor handle 14 and the razor cartridge 12 thus minimizing small radii and corners that are difficult to manufacture in the mating surfaces of two components. Even small gaps between the razor cartridge and the cartridge interconnector 22 may allow for the accumulation of hair and shaving debris, which may be difficult to rinse away without disconnecting the shaving razor cartridge 12 from the handle 14. Furthermore, the curved end walls 38 and 40 may be less prone to binding and jamming within the opening 26 of the housing 24 (FIG. 2), thus decreasing the required forces to attach and eject the razor cartridge 12 from the handle 14.

The skin contacting surface may have a lengh "L1" extending between the pair of curved lateral end walls 38 and 40 of about 27 mm to about 35 mm. The skin facing surface 32 may have a width "w1" extending between the side walls 34 and 36 of about 2.5 mm to about 4 mm. The skin facing surface 32 may have a length to width ratio of about 5 about 13 and more preferably about 9 to about 11. The size and the length to width ratio of the skin facing surface 32 may be sufficient to provide a consumer noticeable benefit, such as heat or lubrication, while also taking up minimal space on the top surface of the shaving razor cartridge 12 (FIG. 2). In certain embodiments, the skin facing surface 32 may have an area of about about 70 $mm^2$ to about 90 $mm^2$.

The distal end 30 may be stepped. For example, the platform 28 may include a shoulder 42 that extends outwardly beyond the skin facing surface 32. The shoulder 42 may extend beyond one or more of the curved lateral end walls 38 and 40 by a distance "d1" of about 0.5 mm to about 2 mm. The shoulder 42 may not extend completely around the the platform 28. Accordingly, there may be a step at the curved end walls 38 and 40. The shoulder 42 may comprise two shoulders 42. For example, the shoulder 42 at one of the curved end walls 38 may be spaced apart from the shoulder at the other curved end wall 40. The location of the shoulder 42 at the the curved walls 38 and 40 may help minimize the overall size of the cartridge interconnector 22 that must fit into the opening 26 of the shaving razor cartridge 12 (FIG. 2), thus minimizing the size of the shaving razor cartridge 12. By not extending the shoulder 42 completely around the platform 28, the area of the skin facing surface 32 can be maximized thus improving consumer benefits such as heat and moisturization or lubrication delivery to the skin. A height "hl" of the distal end 30 from the shoulder 42 of the platform 28 to the skin facing surface 32 is about 0.5 mm to about 3 mm. The height "hl" may be sufficient to allow the distal end 30 to extend through the cartridge 12 of FIG. 2. The shoulder 42 may help retain the cartridge interconnector 22 within the opening 26 of the housing 24 and provide sufficient support for distal end 30, especially when using razor cartridges that have trimmers mounted on the side or back of the cartridge In certain embodiments, the distal end may extend through the opening 26 (FIG. 2) and the platform 28 may be positioned and/or secured within the opening 26.

Figure 3B:
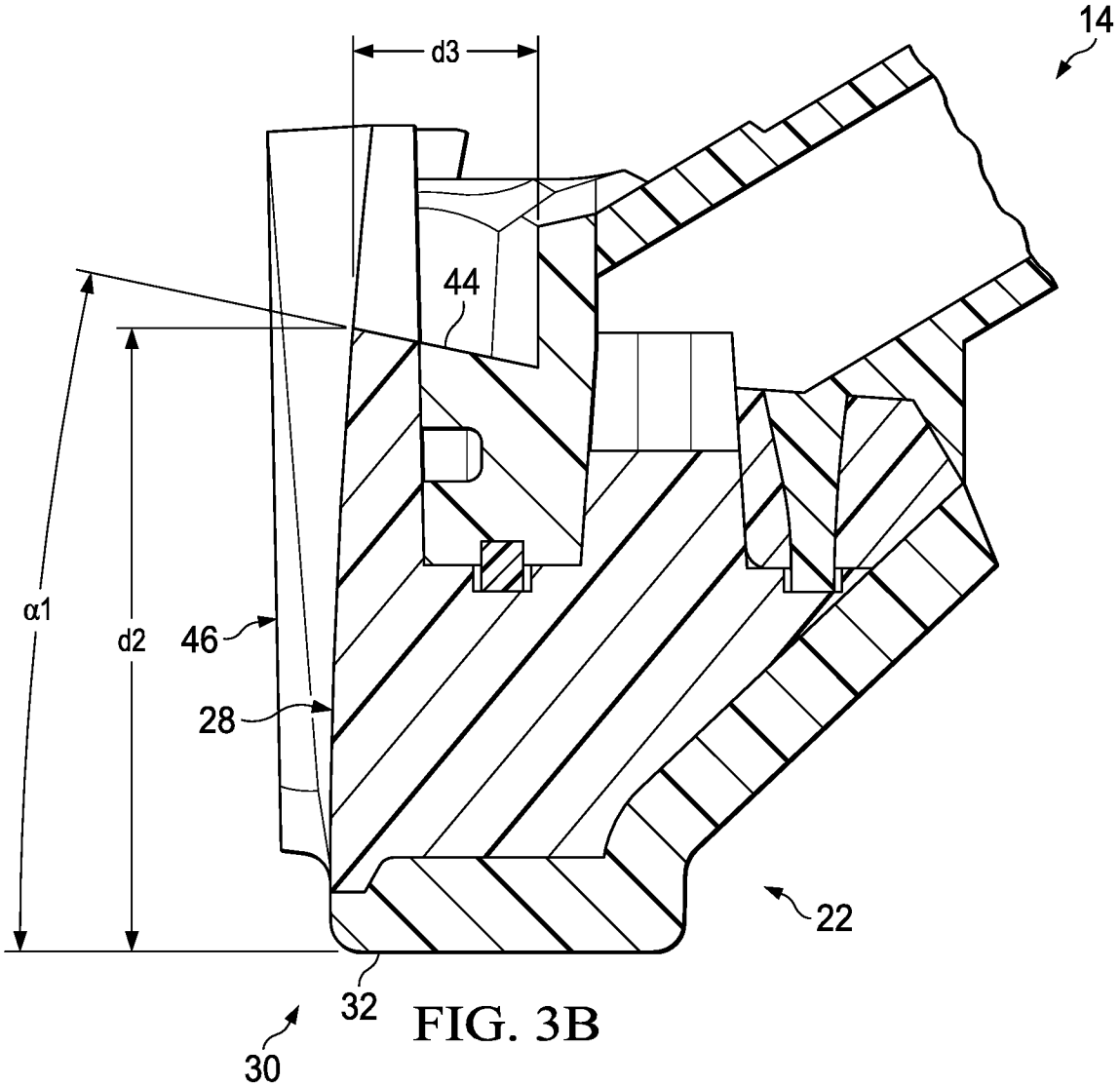
FIG. 3B is a cross sectional view of the shaving razor handle, taken generally along the line 3B-3B of FIG. 3A.

Referring to FIGS. 3A and 3B, a ledge 44 may be located on the upper surface 46 of the platform 28. FIG. 3B is a cross sectional view of the handle 14 with the cartridge interconnector 22, taken generally along the line 3B-3B of FIG. 3A. The ledge 44 may be a recessed surface on the upper surface 46. A distance "d2" from the shoulder 42 of the platform 28 to the ledge 44 may be about 3 mm to about 6 mm A length "L2" of the ledge 44 may be about 4 mm to about 25 mm and preferably about 18 mm A depth "d3" of the ledge 44 may be about 1 mm to about 3 mm and preferably about 1.75 mm. In certain embodiments, ledge 44 may be tapered relative to the skin facing surface 32 of the distal end 30 at an angle $\alpha$1 of about 5 degrees to about 20 degrees, and preferably about 8 degrees to about 12 degrees. The angle $\alpha$1 may help retain the cartridge interconnector 22 on the shaving razor cartridge 12 of FIG. 2. If the angle $\alpha$1 is too great, the shaving razor cartridge 12 (FIG. 2) may be difficult to remove from the cartridge interconnector 22. However, if the angle $\alpha$1 is too small, the shaving razor cartridge 12 (FIG. 2) may fall off the cartridge interconnector 22 during use.

The combination of dimensions between the ledge 44 and the shoulder 42 may influence the performance of the attachment of the cartridge interconnector 22 to the shaving razor cartridge 12 (FIG. 2). The distance "d2" from the shoulder to the ledge 44, the depth "d3" of the ledge, and the angle $\alpha$1 of the ledge 44 may be used to control attachment and detachment forces. The height "hl" from the shoulder 42 to the skin facing surface 32 may be used to control shaving geometry and influence the performance of handles that deliver a benefit to the skin through the skin facing surface 32, for example, delivery of moisture, lubrication or heat.

Figure 4A:
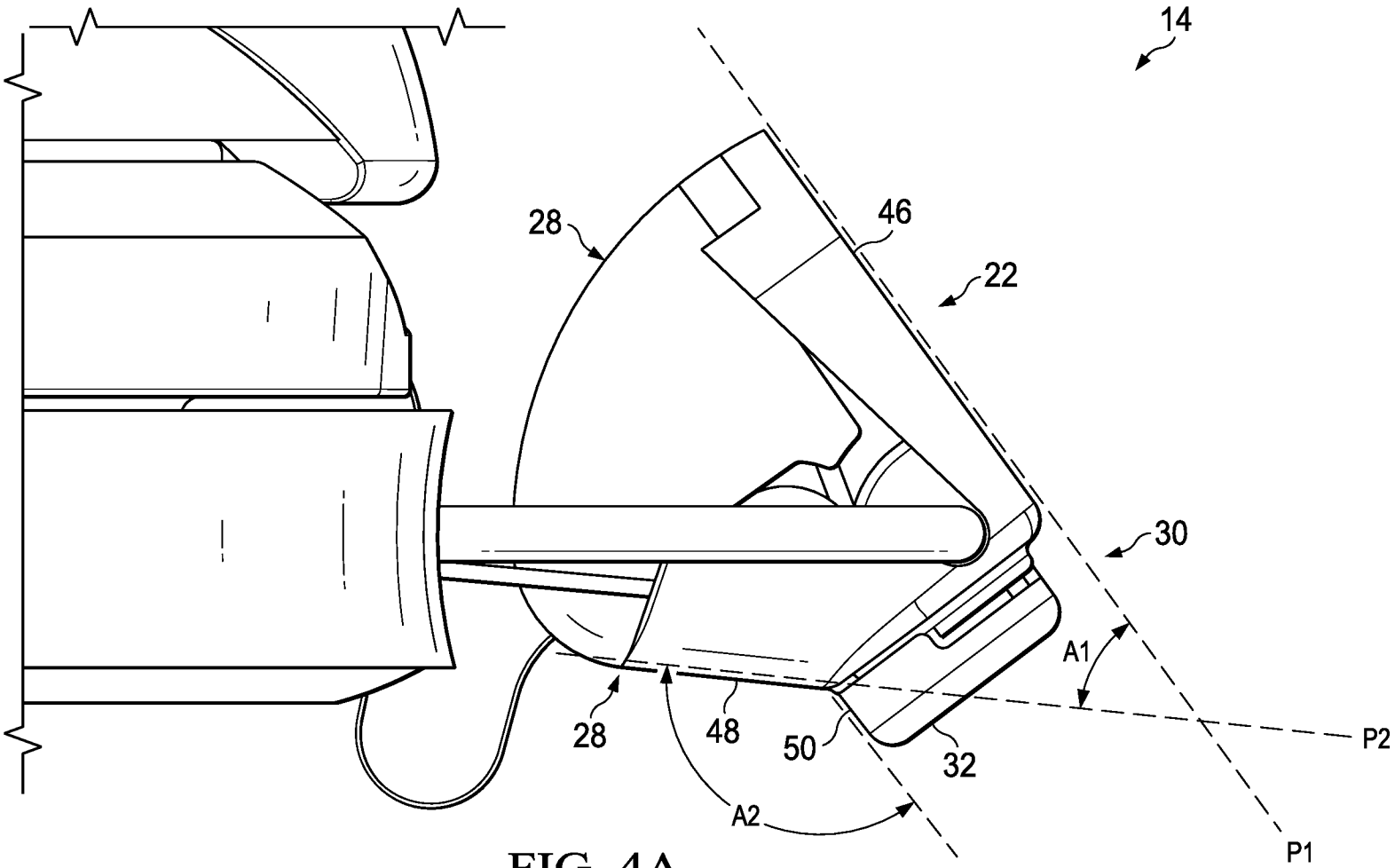
FIGS. 4A-4C are partial side views of the shaving razor handle of FIG. 2.

Referring to FIG. 4A, a partial side view of the shaving razor handle 14 is shown. The platform 28 may have an upper surface 46 on a plane P1 and an opposing lower surface 48 on a plane P2 that define an included angle "A1"

of about 35 degrees to about 60 degrees, and more preferably about 45 to about 55 degrees. The included angle "A1" may provide for a tapered interlock between the cartridge connection member 22 and the shaving razor cartridge 12 (FIG. 2). The lower surface 48 of the platform 28 and a side wall 50 of the distal end 30 may define an excluded angle "A2" of about 125 degrees to about 155 degrees. The side wall 50 may be generally transverse to the skin facing surface 32 and can help increase the retention forces applied to the shaving razor cartridge 12 (FIG. 2) during shaving, especially during use of a trimmer 55 mounted on the side or back of the shaving razor cartridge 12 (FIG. 2). The angle "A2 may facilitate a user to intuitively guide the cartridge interconnector 22 into the opening 26 razor cartridge 12 (FIG. 2) to attach the shaving razor 12 to the handle 10 (FIG. 2).

Figure 4B:
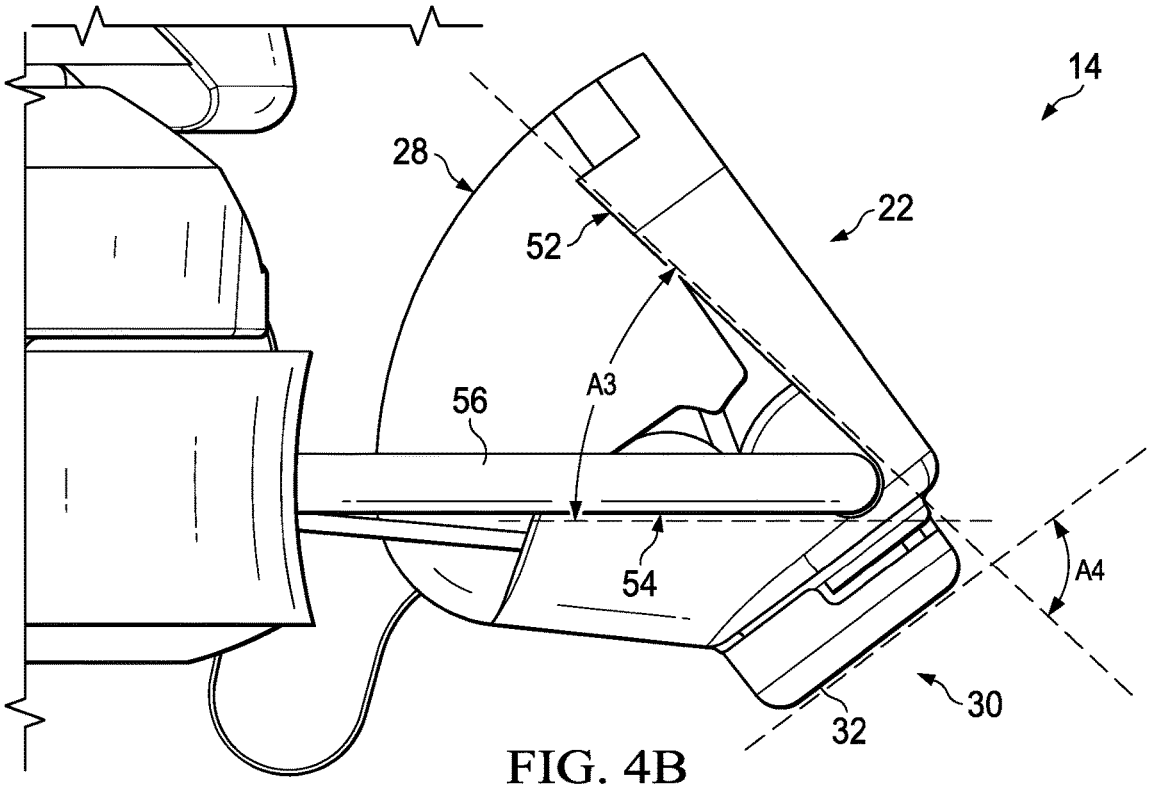
Figure 4C:
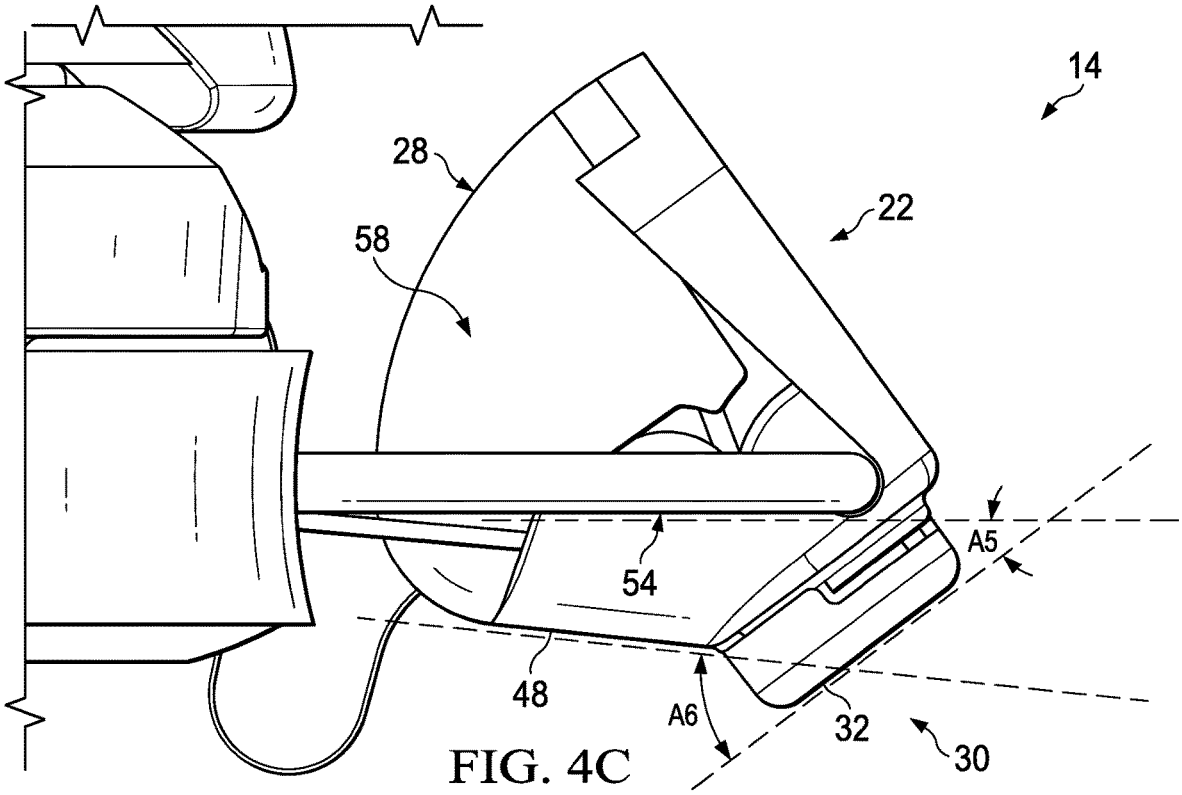

Refering to FIGS. 4B and 4C, partial side views of the shaving razor handle 14 are illustrated. As shown in FIG. 4B, the platform 28 may have an upper pivot stop surface 52 and a lower pivot stop surface 54 that define an included angle "A3" of about 38 degrees to about 57 degrees. The shaving razor handle 14 may include an arm 56 that contacts the upper pivot stop surface 52 and the lower pivot stop surface 54 as the cartridge interconnect member 22 pivots through the range of motion of about 38 degrees to about 57 degrees. In certain embodiments, the arm 56 may be biased against the lower pivot stop surface 54 in a neutral rest position. The upper pivot stop surface 52 may intersect the skin facing surface 32 at an included angle "A4" of about 50 degrees to about 120 degrees and preferably about 80 degrees. The angle "A4" may be sufficient to enable the skin facing surface contacts the skin's surface during a shaving stroke, even at an upper pivot limit of the cartridge interconnect member 22. Similarly, the lower pivot stop surface 54 may intersect the skin facing surface 32 at an included angle "A5" of about 10 degrees to about 70 degrees and preferably about 37 degrees, as shown in FIG. 4C. The platform 28 may define a "V" shaped notch 58 having the lower pivot stop surface 54 and the upper pivot stop surface 52. The notch 58 may provide for a more robust pivot stop than tab members, which may be more likely to break. The skin facing surface 32 may intersect the lower surface 48 of the platform 28 at an included "A6" of about 5 degrees to about 60 degrees and preferably about 43 degrees. The angle "A6" may facilitate a user to intuitively guide the cartridge interconnector 22 into the opening 26 razor cartridge 12 (FIG. 2) to attached the shaving razor 12 to the handle 10 (FIG. 2).

Figure 5:
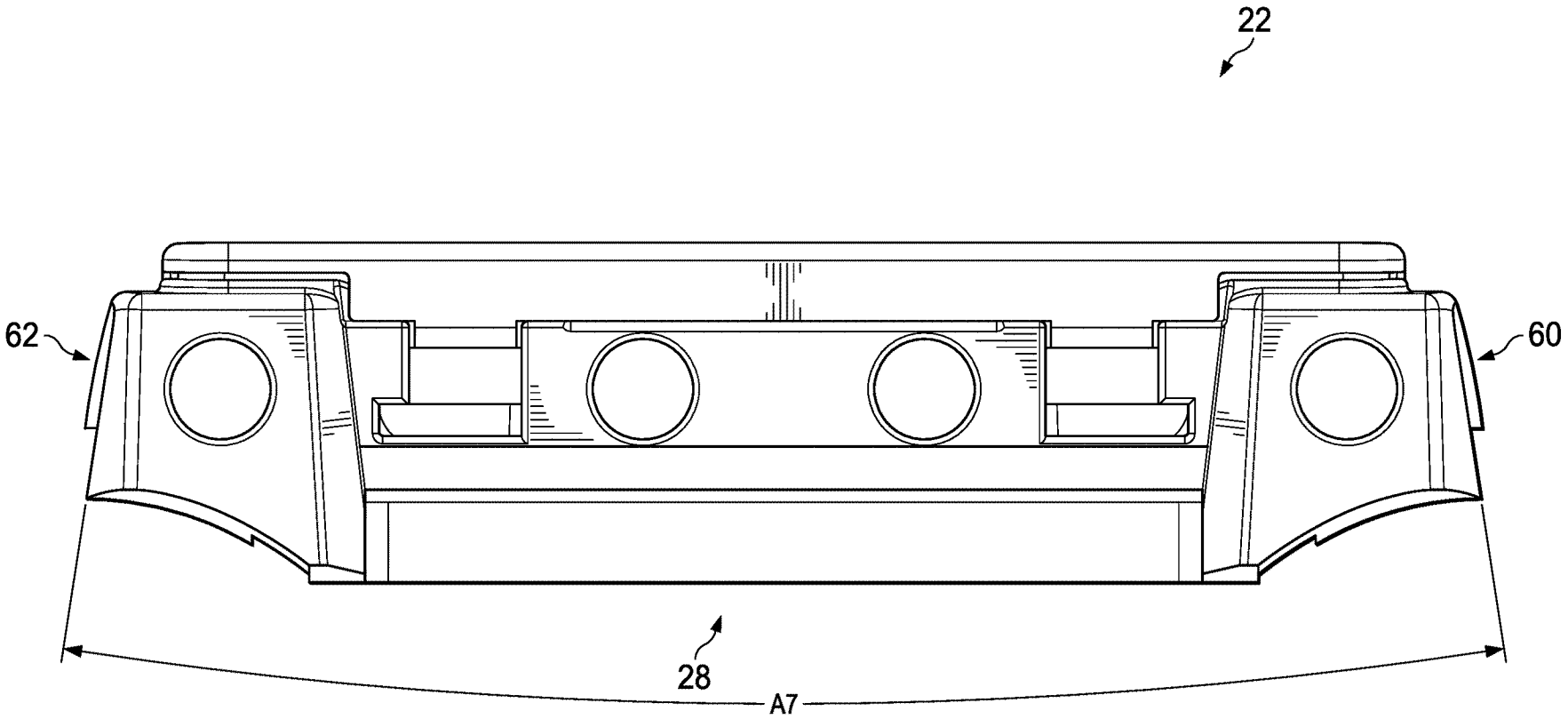
FIG. 5 is a front view of a cartridge interconnector of the razor handle of FIG. 2.

Referring to FIG. 5, a front view of the cartridge interconnector 22 is shown. The platform 28 may be tapered in more than one direction. The platform 28 may be tapered in a first direction, as shown by angle A1 of FIG. 4A. The platform 28 may also be tapered in a second direction. For example the platform 28 may have a pair of side walls 60 and 62 that tapered. In certain embodiments, the side walls 60 and 62 may define an angle A7 of about 10 degrees to about 40 degrees, preferably about 15 degrees to about 30 degrees. The taper of the platform 28 in two directions may improve retention of the cartridge interconnector 22 within the opening 26 of the shaving razor cartridge 12 of FIG. 2 may provide a tapered interlock.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor handle comprising:

an elongated gripping portion having a first end; and a cartridge interconnector at a second end of the elongated gripping portion, the cartridge interconnector having a platform having an upper surface and an opposing lower surface, a plane of the upper surface and a plane of the lower surface intersect at a point beyond the cartridge interconnector and define an included angle of 35 degrees to 60 degrees, wherein a distal end of the cartridge interconnector extends from the platform, the distal end having a skin facing surface with a pair of side walls connected by a pair of curved lateral end walls.

2. The shaving razor handle of claim 1 wherein the platform defines a "V" shaped notch.

3. The shaving razor handle of claim 1 wherein the platform has a shoulder that extends beyond the pair of curved lateral end walls.

4. The shaving razor handle of claim 3 wherein a distance from the shoulder of the platform to a ledge on the upper surface of the platform is 3 mm to 6 mm.

5. The shaving razor handle of claim 4 wherein the shoulder extends outwardly 0.5 mm to 2 mm from each of the curved lateral end walls.

6. The shaving razor handle of claim 4 wherein an angle of the ledge relative the skin facing surface is 5 degrees to 20 degrees.

7. The shaving razor handle of claim 4 wherein a depth of the ledge is 1 mm to 3 mm.

8. The shaving razor handle of claim 4 wherein a width of the ledge is 5 mm to 25 mm.

9. The shaving razor handle of claim 1 wherein the skin facing surface has a length between the pair of curved lateral end walls of 27 mm to 35 mm.

10. The shaving razor handle of claim 1 wherein the lower surface of the platform and a side wall of the distal end define an included angle of 125 degrees to 155 degrees.

11. The shaving razor handle of claim 1 wherein the platform has a shoulder that extends outward from the pair of curved lateral end walls.

12. The shaving razor handle of claim 1 wherein the cartridge interconnector is configured to fit within an opening of a shaving razor cartridge.

13. The shaving razor handle of claim 1 wherein a height of the distal end from a shoulder of the platform to the skin facing surface is 0.5 mm to 3 mm.

14. The shaving razor handle of claim 1 wherein an area of the skin facing surface is 70 $mm^2$ to 90 $mm^2$.

15. A shaving razor handle comprising:

an elongated gripping portion having a first end; and a cartridge interconnector at a second end of the elongated gripping portion, the cartridge interconnector having a platform having an upper surface and an opposing lower surface, a plane of the upper surface and a plane of the lower surface intersect at a point beyond the cartridge interconnector and define an included angle of 35 degrees to 60 degrees, a distal end having a skin facing surface extends from the platform, wherein the lower surface of the platform and a side wall of the distal end define an included angle of 125 degrees to 150 degrees.

16. The shaving razor cartridge of claim 15 wherein the skin facing surface that intersects the lower surface of the platform at an included angle of 30 degrees to 60 degrees.

17. The shaving razor cartridge of claim 15 wherein the platform has a lower pivot stop surface that intersects the skin facing surface at angle of 10 degrees to 70 degrees.

18. The shaving razor handle of claim 15 wherein the skin facing surface has a length to width ratio of 5 to 13.

19. The shaving razor handle of claim 15 wherein the platform has an upper pivot stop surface that intersects the skin facing surface of the distal end at angle of 50 degrees to 120 degrees.

20. The shaving razor handle of claim 19 wherein the lower surface of the platform intersects the skin facing surface of the distal end at angle of 5 degrees to 60 degrees.

* * * * *